US005678389A

United States Patent [19]

Henry

[11] Patent Number: 5,678,389

[45] Date of Patent: Oct. 21, 1997

[54] METHOD AND APPARATUS FOR STABILIZING PALLETIZED STACKS OF DISCRETE ITEMS

[76] Inventor: William A. Henry, 2531 Eagle Bay Dr., Orange Park, Fla. 32073

[21] Appl. No.: 567,120

[22] Filed: Dec. 4, 1995

[51] Int. Cl.[6] ..... B65B 11/58; B65B 35/50

[52] U.S. Cl. ..... 53/447; 53/207; 53/449; 53/462; 53/540

[58] Field of Search ..... 53/447, 443, 540, 53/462, 208, 207, 449; 414/788.9, 907, 904

[56] References Cited

U.S. PATENT DOCUMENTS

| | | | |
|---|---|---|---|
| 2,659,187 | 11/1953 | Barnes | 53/447 X |
| 3,855,756 | 12/1974 | Sweeney et al. | 53/447 X |
| 3,953,956 | 5/1976 | Massman | 53/208 X |
| 4,079,566 | 3/1978 | Stoecklin | 53/447 X |
| 4,537,010 | 8/1985 | Mojden et al. | 53/540 X |
| 4,546,593 | 10/1985 | Lasscock | 53/447 X |
| 4,821,491 | 4/1989 | Rias | 53/449 X |
| 4,852,330 | 8/1989 | Carangelo | 53/447 X |
| 4,897,980 | 2/1990 | Geyser et al. | 53/447 X |

*Primary Examiner*—James F. Coan
*Attorney, Agent, or Firm*—Thomas C. Saitta

[57] ABSTRACT

An apparatus for securing and stabilizing stacks of discrete items on pallets, such as bags of powdered or granular material, comprising a bottom member, a top member, side members securing means and an adhesive layer between one or more layers of the discrete items, where the bottom member, top member and side members are positioned so as to enclose the stack of discrete items. Preferably, flap members perpendicular to the edges of some or all of the bottom, top or side members are provided to further secure the members relative to the stack and to each other. Most preferably, the side members are provided with extended top flaps having cut lines and score lines to allow the side members to be properly sized according to the height of the stack.

15 Claims, 2 Drawing Sheets

FIG. 1
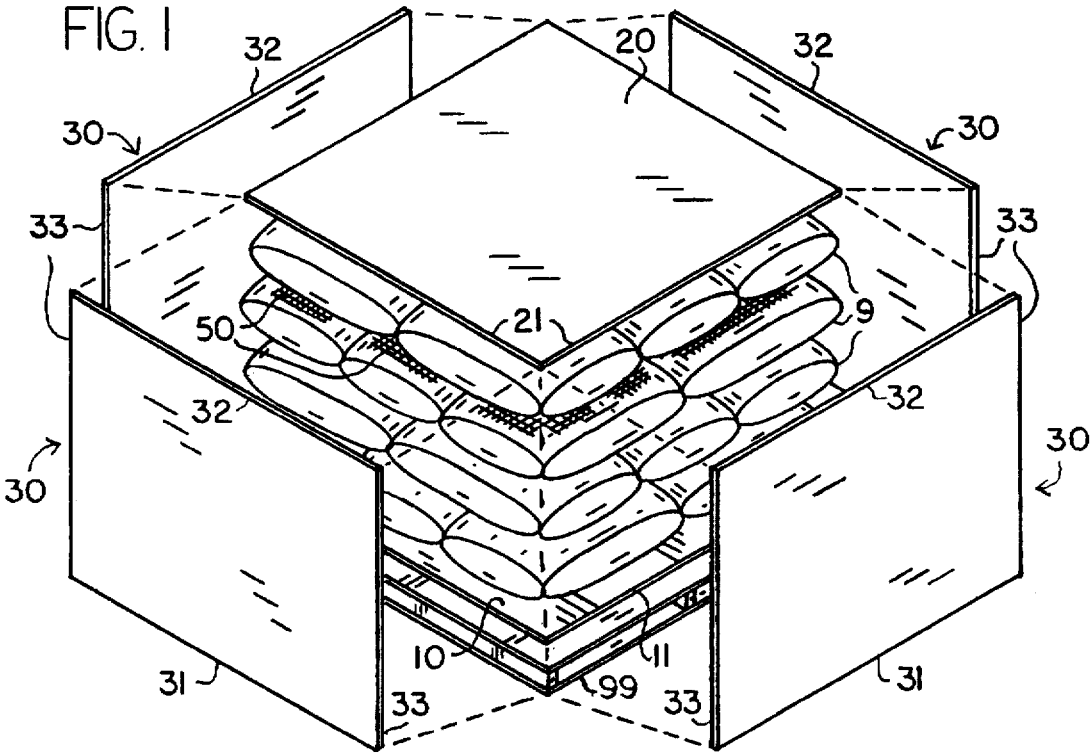
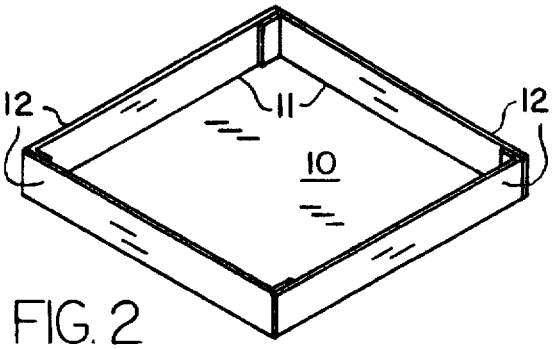
FIG. 2
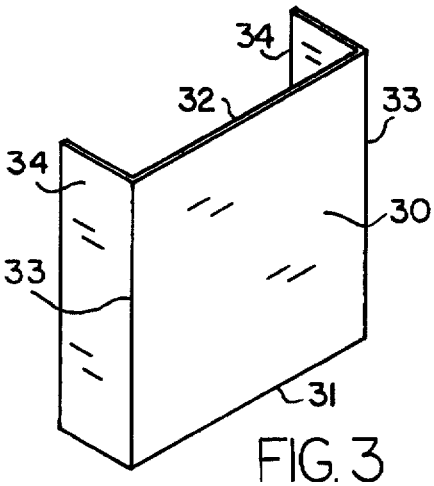
FIG. 3
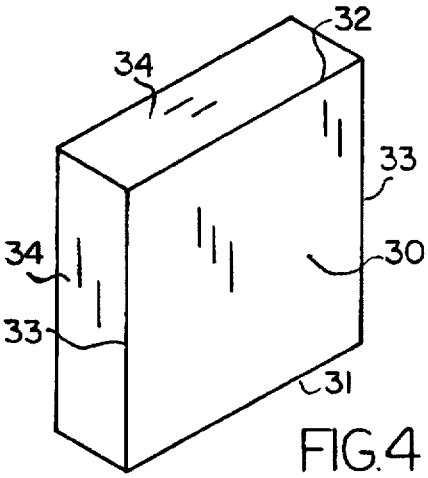
FIG. 4

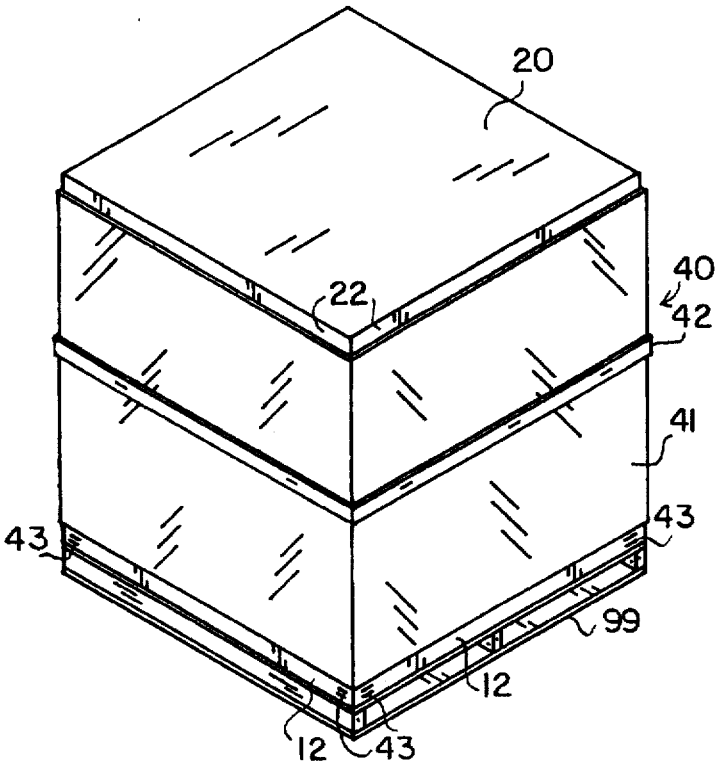
FIG. 5
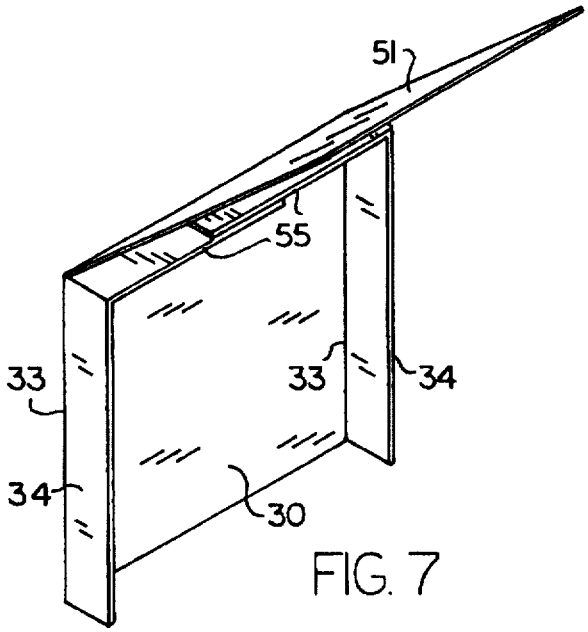
FIG. 7
FIG. 6
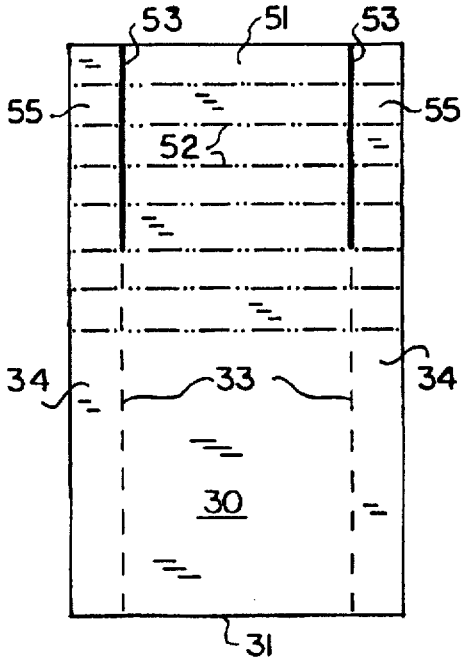

METHOD AND APPARATUS FOR STABILIZING PALLETIZED STACKS OF DISCRETE ITEMS

BACKGROUND OF THE INVENTION

This invention relates generally to the field of palletized stacking systems, and more particularly to a method and apparatus for stabilizing and securing layered stacks of discrete items on a pallet for bulk transportation or storage purposes. Even more particularly, the invention relates to a method and apparatus comprising integrated components interconnected to create a stable container for the discrete items, the components comprising individual bottom, top and side members secured to each other by alternative fastening means and secured in place around the loaded stack of discrete items.

The method for shipment of large numbers of bulk discrete items, such as for example bags containing granular or powdered materials such as powdered milk, cement or the like, typically involves stacking the items in layers onto a pallet accessible to forklifts or hand trucks. The use of pallet-sized, pre-formed bulk containers, cartons or boxes is not practical, since there is no easy and efficient way to load and unload the individual discrete items from the pre-formed container. The items are stacked onto the pallets with differing patterns between rows to help stabilize the pile against shifting and lateral movement. External straps or an elastic plastic sheeting material are often placed around the stacked items to maintain them in place. This method leaves much to be desired, in that a large amount of shifting occurs in transportation when this method is used, which leads to loss of product due to ruptured bags and increased costs due to the additional labor required to restack the pallets. Additionally, the weight of the stack, often as much as 2.1 metric tons, usually causes the bottom bags to protrude through the slats of the standard pallets, where they are often ruptured by the forks of the handtruck or forklift when moving the pallet. In situations involving the worst shipping conditions, such as those encountered on ocean going vessels, it is normal to incur damage or loss of up to 26 percent of a shipment of goods due to shifting and rupture in transit and during pallet loading or unloading from the vessel.

It is an object therefore to provide a method and apparatus which prevents shifting and lateral movement of palletized stacks of discrete items, which in turn prevents damage to the items. It is an object to provide such an apparatus that protects the vulnerable areas of the stack, including the bottom, top, edges and corners. It is an object to provide such an apparatus which does not significantly increase either the cost or labor required to ship, transport or store the palletized items. It is an object to provide such an apparatus that can be readily utilized during normal stacking operations, whereby the apparatus can be constructed around the stacked items. It is an object to preferably provide such an apparatus that comprises a top member, bottom member and side members providing increased protection on all edges and corners of the stack, and further comprising means to secure the components together, and further comprising adhesive means to more securely stabilize the items relative to each other.

SUMMARY OF THE INVENTION

The invention comprises in general an apparatus for stabilizing layered stacks of discrete items, such as for example bags containing granular or powdered material such as powdered milk, cement, etc., loaded on pallets for bulk transportation. The apparatus comprises a bottom member, a top member and four upstanding side members, structured such that the combination of all members results in the formation of a relatively rigid container enclosing the layered stack of discrete items. Preferably, the bottom member and top member have flaps extending perpendicularly from each of their respective sides, with adjacent flaps being joined together by suitable mechanical or adhesive fasteners, whereby the bottom member and top member each form a tray or open-topped, short-walled container. The bottom member, top member and side members are preferably constructed of a relatively rigid, lightweight, puncture-resistant material, such as for example stiff paperboard or corrugated cardboard. The side members are sized such that their top and bottom edges abut the sides of the top member and bottom member, preferably on the interior side of the flap members of the top and bottom members. Additionally, it is preferred that at least two of the side members further comprise side flap members extending perpendicularly from the side edges, and in an alternative embodiment also from the top and bottom edges. In the most preferred embodiment, the side members each comprise side flaps and an extended top flap, with score and cut lines to allow adjustment of the top edge relative to the height of the layered stack. Securing means to join the members to each other may comprise any suitable means to fixedly secure the components in a stable manner, such as for example mechanical fasteners, adhesive material, elastic material or shrink wrap material. In the most preferred embodiment, adhesive layers, applied by spraying, rolling or brushing an adhesive directly onto the discrete items, are interspersed between the individual layers of the stacked discrete items.

BRIEF DESCRIPTION OF THE DRAWINGS

FIG. 1 is an expanded perspective view showing the bottom member, top member, side members and internal adhesive layers relative to a layered stack of discrete items stacked onto a standard pallet.

FIG. 2 is a perspective view of the preferred embodiment of the top or bottom member.

FIG. 3 is a perspective view of one preferred embodiment of the side members.

FIG. 4 is a perspective view of another preferred embodiment of the side members.

FIG. 5 is a perspective view of the invention showing the apparatus installed around a stack of discrete items and illustrating various securing means for the individual members.

FIG. 6 is a front view of the most preferred embodiment of the side members, shown in the unfolded state.

FIG. 7 is a perspective view of the most preferred embodiment of the side members, shown in the partially folded state.

DETAILED DESCRIPTION OF THE INVENTION

With reference now to the drawings, the invention will now be described in detail with respect to the best mode and preferred embodiment. In general, as shown in FIG. 1, the invention comprises a method and apparatus for securing a number of bulk discrete items 9, such as bags of powder or granular material, stacked in multiple layers on a pallet 99 for transportation and storage. The apparatus comprises in general a bottom member 10, a top member 20, side members 30 and securing means 40 to connect the individual components of the invention to form a stable, relatively rigid enclosure for the stack of discrete items 9. The bottom member 10, top member 20 and side members 40 are preferably composed of a relatively rigid, puncture resistant, lightweight, inexpensive material such as paperboard or corrugated cardboard. In the preferred embodiment, an adhesive layer 50 is provided between one or more of the individual layers of the discrete items 9.

The most basic embodiment of the invention is illustrated in FIG. 1. The bottom member 10 is a generally flat member sized to be coextensive with the perimeter dimensions of the pallet 99 and stack of discrete items 9. The bottom member 10 has four edges 11 corresponding to the four sides of the pallet 99. The bottom member 10 bridges the gaps between the slats of the pallet 99, preventing the discrete items 9 in the lowermost layer from protruding into the body of the pallet 99 where they can be ruptured either by the weight of the full stack or by the forks of a forklift or handtruck. The top member 20 is also generally flat and is sized to be coextensive with the perimeter dimensions of the pallet 99 and stack of discrete items 9. The top member 20 has four edges 21 corresponding to the four sides of the pallet 99. The top member 20 prevents rupture of the top layer of discrete items 9.

At least two but preferably four side members 30 are provided, each side member 30 being a generally flat member sized to correspond to the pallet 99 dimensions in width and to the height of the stack of discrete items 9 in the vertical direction. Each side member 30 has a lower edge 31, an upper edge 32 and two lateral edges 33. The lower edge 31 is designed to match one of the edges 11 of the bottom member 10 and the upper edge 32 is designed to match one of the edges 21 of the top member 20, such that each side member 30 can be positioned with its lower edge 31 abutting the edge 11 of the bottom member 10 and its upper edge 32 abutting the edge 21 of the top member 20. In this manner, the combination of bottom member 10, top member 20 and four side members 30, when properly positioned, will fully enclose the stack of discrete items 9. To implement the apparatus, the bottom member 10 is placed onto an empty pallet 99 and the discrete items 9 are stacked in layers to the desired or maximum allowable height. The side members 30 and the top member 20 is then properly positioned.

To maintain the component elements in position, it is necessary to provide securing means 40 to affix or connect the components relative to each other, to the pallet 99 and to the stack of discrete items 9 to prevent unwanted movement. As shown in FIG. 5, the securing means 40 can comprise any number of suitable means or devices. The components may be joined by mechanical fasteners 43, such as staples or rivets, by strap or adhesive backed members 42, by elastic sheeting material or heat shrink material 41, or by adhesive between the components. All of these securing means 40 are well known in the art.

In the preferred embodiment, at least one but preferably a plural number of the layers of discrete items 9 are further secured against shifting by application of an adhesive layer 50 between adjacent layers of discrete items or also between the top and bottom layers and the top member 20 and the bottom member 10. The adhesive may be of any suitable type which prevents lateral shifting or sliding by creating a tacky surface, but which is not permanent or of sufficient strength so as to prevent separation of the individual discrete items 9 at the time of unloading. The adhesive layer 50 may be applied to the discrete items 9 by spraying, brushing, rolling or any other suitable application method which is relatively quick.

It is preferred that the components of the invention be designed to provide increased structural support and integrity, as well as allowing for the creation of a more securely joined combination, by providing flaps which extend perpendicularly from the edges of various members. The flaps provide protection to the corners and edges of the stack of discrete items 9, and also create a seat or stop to properly position each member relative to its adjoining member. As shown in FIG. 2, the bottom member 10 is preferably constructed with plural, preferably four, upstanding flap members 12 which extend perpendicularly from each edge 11. Preferably, the flap members 11 are joined to each other by suitable known fastening means to form a tray configuration with an extensive bottom flanked by four short upstanding walls. By creating the tray configuration, the lower edge 31 of each side member 30 is restrained from any outward, lateral or downward movement by flap members 12. As seen in FIG. 5, the top member 20 is also preferably constructed with plural, preferably four, downward directed flap members 22 extending perpendicular to each edge 21 to form a tray-like configuration. The flap members 21 may also be joined to each other and act to retain the upper edge 32 of each side member 30 from outward, lateral or upward movement.

In a still further preferred embodiment, the side members 30 further comprise flap members 34 extending from one or more of the edges 31, 32 or 33 of side member 30. FIG. 3 shows a construction where the side members 30 are provided with flap members 34 extending from the lateral edges 33. These lateral flap members 34 protect the vertical edges of the stack of discrete items 9 and further secure the stack and the side members 30 from lateral movement. The lateral flap members 34 also provide better support to the top member 20 since each corner will now be supported by overlapping layers of adjacent side members 30. This is especially desirable since the loaded pallets 99 are usually themselves stacked on top of each other during tramit.

A more preferred alternative embodiment is shown in FIG. 4, where the side member 30 has perpendicular flap members 34 extending from all edges 31, 32 and 33. The structural integrity and load bearing capability of the apparatus is improved by the addition of these flap members 34 in the same manner as explained above.

The most preferred embodiment of the side members 30 is shown in FIGS. 6 and 7. While the lateral dimensions of the pallet 99 are standardized, the height of the stacked discrete items 9 will vary depending on the particular goods being transported. The embodiments described above anticipate knowledge of the stack height, such that the side members 30 can be formed in advance with the corresponding proper height. If the stack of discrete items 9 is shorter than anticipated, the side members 30 must be adapted accordingly by cutting off some of the bottom edge 31. If the stack is taller than anticipated, then the side members 30 will not extend the full vertical height of the stack, leaving some discrete items 9 exposed and weakening the protection afforded by the apparatus. To provide an apparatus which is suitable for use with stacks of various heights, it is preferred that the side members 30 be constructed as shown in FIG. 6, such that the side member 30 further comprises an extended top flap member 51 which preferably extends a distance greater than half the height of side member 30. The extended top flap member 51 is provided with horizontal score lines 52 at various increments which allow top flap member 51 to be folded along the appropriate score line 52 to create the proper height for side member 30. Vertical cut lines 53 are provided on the lines extending from the joint lime between the side member 30 and the side flaps 34. The cut lines 53 may be pre-cut or cut prior to assembly. To create the properly sized side member 30, the cut lines 53 are cut to the proper score line 52. The side flaps 34 are then formed at a right angle to the side member 30 itself, creating two flap extensions 55 which are folded inward as shown in FIG. 7. The extended top flap member 51 is then folded downward along the proper score line 52.

To assemble the apparatus in the most preferred embodiment, a tray-like bottom member 10 is positioned onto the empty pallet 99. The discrete items 9 are stacked in layers of alternating pattern to the maximum allowable or preferred height, with application of a tacky adhesive layer 50 between some or all of the individual layers. Each side member 30 is then placed in position on each side of the stack with the side flaps 34 folded perpendicularly and the lower edge 31 inserted inside the bottom flap members 12. If the cut line 53 does not extend the correct distance, the operator cuts the cut line 53 to the correct score line 52. The flap extensions 55 are folded down onto the top layer of the discrete items 9 and the large extended top flap member 51 is folded down on top of the flap extensions 55 and the stack. When all four side members 30 are in place, the top member 20 is put into place, the top flap members 22 enclosing each of the side members 30. The components are then joined using stretch wrap, shrink wrap, banding material or the like to create a solid, integral assembly. The multiple layers dramatically increase the protective and load-bearing capability of the assembly, especially at the corners and along the edges.

It is understood that equivalents or substitutions of certain components may be obvious to those skilled in the art, thus the true and full scope and definition of the invention therefore is to be as set forth in the following claims.

I claim:

1. An apparatus for stabilizing a layered stack of plural discrete items on a pallet, comprising:

(A) a relatively rigid bottom member having four edges and four flap members each extending perpendicularly upward from one of said four edges of said bottom member, where each said upstanding flap member is joined to the adjacent flap member, said bottom member positioned on top of and coextensive with said pallet to support a layered stack of discrete items;

(B) a relatively rigid top member having four edges and four flap members each extending perpendicularly downward from one of said four edges of said top member, where each said flap member is joined to the adjacent flap member, said top member positioned on top of and coextensive with said layered stack of discrete items;

(C) four relatively rigid, upstanding side members each having a lower edge, two lateral edges and an upper edge, adapted to be positioned abutting the side of said layered stack of discrete items, where said lower edge of each said side member abuts one of said four edges of said bottom member, and said upper edge of each said side member abuts one of said four edges of said top member, the combination of said side members, said top member and said bottom member completely enclosing said layered stack of discrete items;

(D) adhesive applied directly to said discrete items whereby discrete items adhere directly to adjacent discrete items within said layered stack, and (E) means to secure together said bottom member, said top member, and said side members to form a closed container for said discrete items.

2. The apparatus of claim 1, where said securing means comprises an adhesive material.

3. The apparatus of claim 1, where said securing means comprises an elastic material.

4. The apparatus of claim 1, where each of said upstanding side members abuts one of said four edges of said bottom member on the interior of one of said flap members.

5. The apparatus of claim 1, where said securing means comprises a shrink wrap material.

6. The apparatus of claim 1, where said securing means comprises mechanical fasteners.

7. The apparatus of claim 1, where each of said upstanding side members abuts one of said four edges of said top member on the interior of one of said flap members.

8. The apparatus of claim 1, where said side members further comprise flaps extending perpendicularly from one or more of said edges of at least two of said side members.

9. An apparatus for stabilizing a layered stack of plural discrete items on a pallet, comprising:

(A) a relatively rigid bottom member having four edges, adapted to be positioned on top of and coextensive with said pallet to support a layered stack of discrete items;

(B) a relatively rigid top member having four edges, adapted to be positioned on top of and coextensive with said layered stack of discrete items;

(C) four relatively rigid, upstanding side members each having a lower edge, two lateral edges and an upper edge, adapted to be positioned abutting the side of said layered stack of discrete items, where said lower edge of each said side member abuts one of said four edges of said bottom member, and said upper edge of each said side member abuts one of said four edges of said top member; and (D) means to secure together said bottom member, said top member, and said side members to form a closed container for said discrete items, where said side members further comprise flaps extending perpendicularly from one or more of said edges of at least two of said side members and where said side members further comprise extended top flap members having cut lines aligned with said lateral edges and horizontal score lines adapted to allow said extended top flap member to be folded perpendicularly to said side member.

10. The apparatus of claim 9, where said bottom member further comprises four flap members each extending perpendicularly upward from one of said four edges of said bottom member.

11. The apparatus of claim 9, where said top member further comprises four flap members each extending perpendicularly downward from one of said four edges of said top member.

12. The apparatus of claim 10, where said top member further comprises four flap members each extending perpendicularly downward from one of said four edges of said top member.

13. A method of stabilizing a stack of discrete items on a pallet comprising the steps of:

(A) providing a bottom member of relatively rigid material having flap members adapted to fold perpendicularly and placing said bottom member onto said pallet and folding said flap members to form a tray-like configuration, (B) loading a number of discrete items in layers onto said bottom member to form a stack having four sides and a top, (C) providing four side members of relatively rigid material having flap members adapted to fold perpendicularly and placing said side members against the sides of said stack and folding said flap members against said sides of said stack, whereby said side members abut said bottom member, (D) providing a top member of relatively rigid material having flap members adapted to fold perpendicularly and placing said top member onto the top of said stack and folding said flap members to form a tray-like configuration, whereby said top member abuts said side members, (E) providing securing means to affix said bottom member, side members and top member together to form a stable assembly.

14. The method of claim 13, further comprising the step of applying a tacky adhesive directly onto one or more of said layers of discrete items whereby said discrete items in said one or more layers adhere directly to adjacent discrete items.

15. The method of claim 13, further providing said side members with extended top flap members adapted to be folded perpendicularly, cut lines and score lines, and cutting said cut lines to correspond to the height of said stack to form flap extensions, and folding said flap extensions and extended top flap members onto said top of said stack prior to placement of said top member.

* * * * *